US011037518B2

(12) United States Patent
Toyoda et al.

(10) Patent No.: US 11,037,518 B2
(45) Date of Patent: Jun. 15, 2021

(54) DISPLAY DRIVER

(71) Applicant: Synaptics Japan GK, Tokyo (JP)

(72) Inventors: Go Toyoda, Tokyo (JP); Takashi Nose, Tokyo (JP); Yoshitaka Iwasaki, Tokyo (JP); Akihito Kumamoto, Tokyo (JP)

(73) Assignee: Synaptics Japan GK, Tokyo (JP)

( * ) Notice: Subject to any disclaimer, the term of this patent is extended or adjusted under 35 U.S.C. 154(b) by 486 days.

(21) Appl. No.: 15/000,117

(22) Filed: Jan. 19, 2016

(65) Prior Publication Data

US 2016/0217763 A1 Jul. 28, 2016

(30) Foreign Application Priority Data

Jan. 26, 2015 (JP) ..... JP2015-011953

(51) Int. Cl.

| | |
|---|---|
| ***G09G 3/3266*** | (2016.01) |
| ***G09G 5/00*** | (2006.01) |
| ***G09G 3/36*** | (2006.01) |
| ***G09G 3/20*** | (2006.01) |

(52) U.S. Cl.

CPC ..... *G09G 5/006* (2013.01); *G09G 3/2096* (2013.01); *G09G 3/3266* (2013.01); *G09G 3/3674* (2013.01); *G09G 2310/0267* (2013.01); *G09G 2310/0278* (2013.01); *G09G 2310/06* (2013.01); *G09G 2310/08* (2013.01); *G09G 2360/18* (2013.01); *G09G 2370/10* (2013.01)

(58) Field of Classification Search

CPC .... G09G 5/006; G09G 3/2096; G09G 3/3674; G09G 3/3266; G09G 2370/10; G09G 2310/08; G09G 2310/0278; G09G 2310/0267; G09G 2310/06; G09G 2360/18; G09G 3/3677

See application file for complete search history.

(56) References Cited

U.S. PATENT DOCUMENTS

| | | | | |
|---|---|---|---|---|
| 2006/0017852 | A1* | 1/2006 | Iwaki | G06T 3/40 348/581 |
| 2007/0047828 | A1* | 3/2007 | Ishii | G06T 3/4007 382/232 |
| 2007/0075956 | A1* | 4/2007 | Satou | G09G 3/3614 345/98 |
| 2007/0242159 | A1* | 10/2007 | Iwaki | G09G 5/363 348/558 |

(Continued)

FOREIGN PATENT DOCUMENTS

| | | | |
|---|---|---|---|
| JP | H06-130906 | A | 5/1994 |
| JP | 2002-244610 | A | 8/2002 |

(Continued)

*Primary Examiner* — Jeff Piziali

(74) *Attorney, Agent, or Firm* — Ferguson Braswell Fraser Kubasta PC

(57) ABSTRACT

A display driver is disclosed that includes: an external interface circuit having input modes as interface modes to input display data. The display driver keeps the scan driving of a display panel stopped during a predetermined period until the driving of the display panel by display data input in the interface mode after switching is enabled in case that the interface mode of the external interface circuit is switched in the middle of driving the display panel based on display data input through the external interface circuit.

20 Claims, 4 Drawing Sheets

(56) References Cited

U.S. PATENT DOCUMENTS

| | | | | |
|---|---|---|---|---|
| 2008/0055218 | A1* | 3/2008 | Tsuda | G02F 1/136213 345/87 |
| 2008/0129761 | A1* | 6/2008 | Kim | G09G 3/2096 345/690 |
| 2008/0198148 | A1* | 8/2008 | Miyata | G09G 3/2096 345/204 |
| 2011/0115839 | A1* | 5/2011 | Takahashi | H01L 27/1225 345/698 |
| 2012/0038618 | A1* | 2/2012 | Koyama | G09G 3/3688 345/212 |
| 2013/0057763 | A1* | 3/2013 | Cha | G09G 5/006 348/554 |
| 2013/0215094 | A1* | 8/2013 | Choi | G09G 3/2025 345/211 |
| 2014/0118406 | A1 | 5/2014 | Sakamaki et al. | |
| 2014/0313181 | A1* | 10/2014 | Hong | G09G 3/3696 345/212 |
| 2015/0049274 | A1* | 2/2015 | Kim | G09G 3/3614 349/41 |

FOREIGN PATENT DOCUMENTS

| | | | |
|---|---|---|---|
| JP | 2005-321583 | A | 11/2005 |
| JP | 2008-197600 | A | 8/2008 |
| JP | 2013-054356 | A | 3/2013 |
| JP | 2014-089314 | A | 5/2014 |
| WO | WO-2005045795 | A1 | 5/2005 |

* cited by examiner

DISPLAY DRIVER

CROSS-REFERENCE TO RELATED APPLICATIONS

The Present application claims priority from Japanese application JP 2015-011953 filed on Jan. 26, 2015, the content of which is hereby incorporated by reference into this application.

BACKGROUND

The invention relates to a display driver operable to drive a display panel, and especially relates to a technique useful in application to e.g., a liquid crystal display driver.

Examples of an interface method which allows a display driver to receive display data from a host device include: a synchronous interface method by which a display driver receives display data in synchronization with a display timing; and an asynchronous interface method by which a display driver receives display data in asynchronization with a display timing. In the former method, display data are input as pixel data streams in synchronization with a display timing, whereas in the latter method, data to write in a frame buffer memory are input in asynchronization with a display timing, and data written in the frame buffer memory are read out in synchronization with the display timing. The former synchronous interface method is used for input of moving-image data and the like, and the latter asynchronous interface method is used for input of still image data, menu operation data and the like. Whether to handle input of display data by synchronous interface or asynchronous interface will be appropriately changed depending on the display control state of a host device. Especially, synchronous interface does not require that display data be accumulated in a frame buffer memory, but in case that the synchronous interface has been switched to the asynchronous interface, asynchronously input display data must be written once in a frame buffer and then, be read out from there in synchronization with a display timing. Therefore, it takes a time until the display of asynchronously input display data are enabled after switching of the input of display data from the synchronous interface to the asynchronous interface, during which image display is disturbed. To even out such disturbance, the action of displaying in all white or black during only a period of one to several frames is performed. For instance, in the case of making an attempt to display an operation menu in display of a moving picture, a situation as described above develops.

A technique for avoiding the disturbance of display as described above and further, the disturbance of display attributed to white or black display insertion has been already disclosed. According to such a technique, display data input through a synchronous interface are sequentially stored in a frame buffer memory in parallel with the display thereof; and such disturbance of displays can be suppressed by switching the display action to the one which uses display data stored in the frame buffer memory immediately on the switching of the synchronous interface to asynchronous one.

Examples of the above technique include the one disclosed in Japanese Unexamined Patent Application Publication No. JP-A-2014-89314.

SUMMARY

Display drivers are described herein. In one example, a display driver is provided that includes an external interface circuit and a control circuit. The external interface circuit has input modes as interface modes to input display data, through which a display panel is driven based on display data input. The control circuit is configured to keep scan driving of the display panel stopped during a predetermined period until the driving of the display panel by display data input in the interface mode after switching is enabled in case that the interface mode of the external interface circuit is switched in the middle of driving the display panel based on the input display data.

In another example, a display driver is provided that includes an external interface circuit, a frame buffer memory, a control circuit and a drive circuit. The external interface circuit has a first interface mode to input display data as streams of pixel data in synchronization with a display timing, and a second interface mode to input display data for write on the frame buffer memory in asynchronization with the display timing. The drive circuit is configured to output signals for scanning pixels of a display panel in synchronization with the display timing, and to output pixel drive signals for display driving the scanned pixels according to display data. The control circuit is configured to stop the pixel scan on the display panel during a predetermined period until the output of the pixel drive signals is enabled based on display data input in the second interface mode in case that display data input is switched from the first interface mode to the second interface mode.

DETAILED DESCRIPTION

Figure 1:
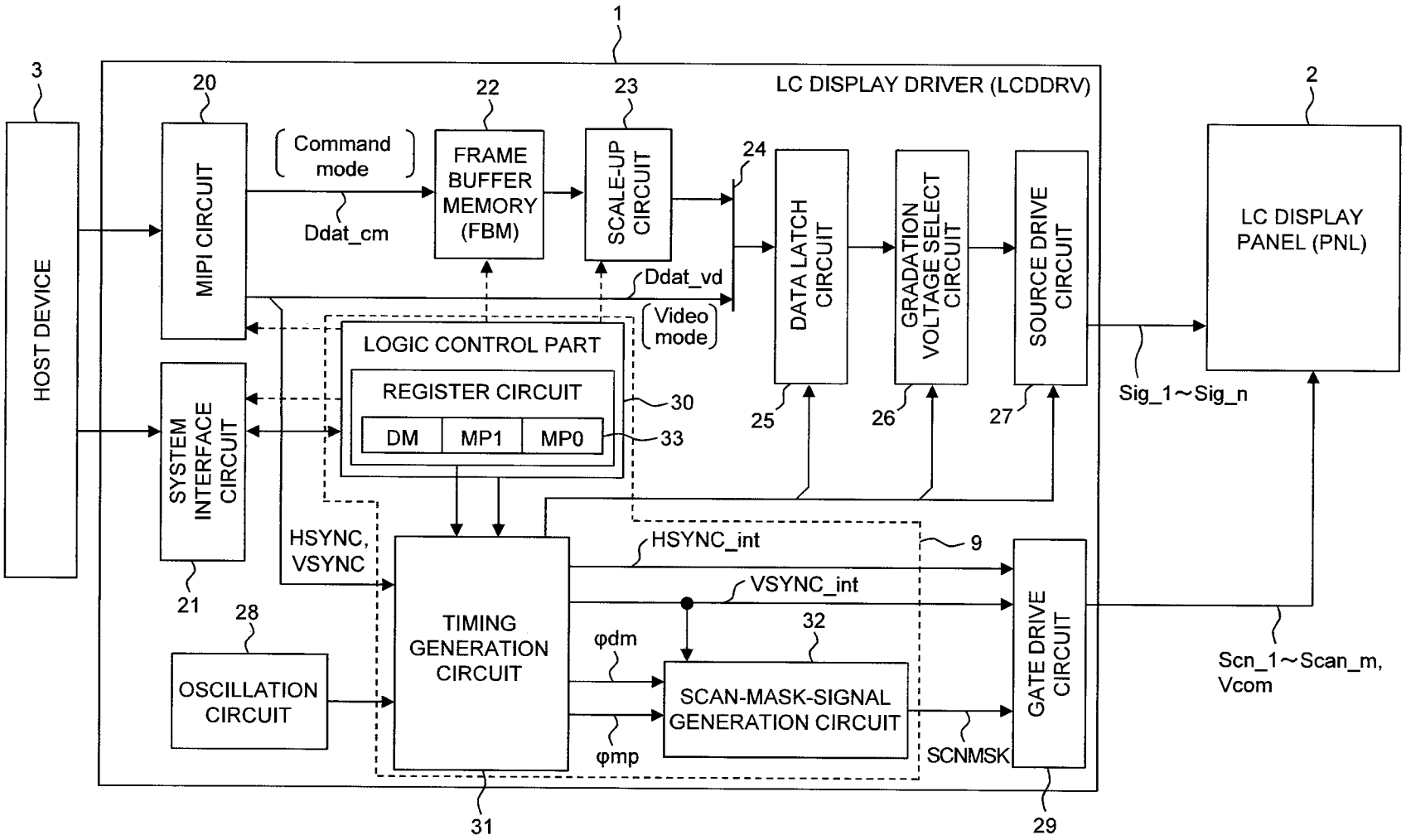
FIG. 1 is a block diagram showing, by example, the schematic structure of a liquid crystal display driver according to one embodiment of the invention.

The inventor has made a consideration about the problems of the action of accumulating display data input through the synchronous interface in a frame buffer memory in parallel with the display thereof.

The first problem is that even if display data input through the synchronous interface are accumulated in the frame buffer memory in parallel with the display thereof, most of the data end up being unused and overwritten, resulting in a large wasteful power consumption.

The second problem is the one accompanying the scale-up of display data. Specifically, as the rise in the resolution of a display panel provided on a personal digital assistance such as a smart phone advances, display data are decreased in quantity by performing a scale-up process of data by the calculation of data interpolation or the like instead of providing RAM for holding image data, such as a frame buffer memory, which accommodates data of one display frame, which also enables the shortening of the time for writing display data into a frame buffer memory. However, the scale-up process is arranged to target display data input through the asynchronous interface and therefore, even if an attempt is made to sequentially store display data input through the synchronous interface in a frame buffer memory in parallel with display thereof as described above, the process of previously accumulating display data of a necessary size in a frame buffer cannot be performed adequately because of the frame buffer memory size smaller than a display frame size, and the disturbance of display cannot be prevented.

The modes for input of display data by a display driver are roughly classified into a synchronous interface and an asynchronous interface. Ina display driver arranged to be able to select interface specifications of MIPI (Mobile Industry Processor Interface), MDDI (Mobile Display Digital Interface), Bus Interface, etc., the problem concerning the disturbance of display as described above can arise not only when switching from the synchronous interface to the asynchronous interface, but also when switching between other input modes. For instance, in case that the switching of input mode changes the number of input lanes in MIPI, display data are still in danger of suffering the disturbance of display in a new input mode until the internal state transition caused by the change is stabilized.

A benefit of the invention provides a display driver arranged so that the disturbance of display owing to the switching of the input mode of display data can be substantially eliminated.

The above and other benefits of the invention and the novel features thereof will become apparent from the description hereof and the accompanying diagrams.

Of the embodiments herein disclosed, the representative embodiment will be briefly outlined below. Now, it is noted that what is described in paired round brackets here is just an example for easier understanding.

Stopping the Scan Driving of a Display Panel Following the Interface Mode Switching The display driver (1) according to one example includes an external interface circuit (20) having, as interface modes to input display data, input modes (i.e., a video mode and a command mode). The display driver drives a display panel (2) based on display data input through the external interface circuit. The display driver further includes a control circuit (9) which keeps the scan driving of the display panel stopped during a predetermined period until the driving of the display panel by display data input in the interface mode after switching is enabled in case that the interface mode of the external interface circuit is switched in the middle of driving the display panel based on the input display data.

According to the above arrangement, with the scan driving of the display panel temporarily stopped, all of the pixels of the display panel can hold the information of signals driven based on the immediately preceding display data without losing it. Therefore, in the event of the switching of the interface mode in the middle of driving the display panel, the scan driving of the display panel is stopped during a predetermined period until the driving of the display panel by display data input in the interface mode after switching is enabled, whereby the occurrence of display disturbance can be suppressed until the internal state transition owing to the change in the interface mode is stabilized.

Stop During a Period of one or more Display Frames

In the display driver, the predetermined period may be made e.g., a period of one or more display frames, of which the unit is a one-display frame period.

Taking into account that the display control and the write of display data into the frame buffer memory are performed in units of the display frame, the above arrangement significantly simplifies the control for temporarily stopping the scan driving of the display panel.

Register to set Predetermined Periods on

In the display driver, the control circuit has a register (33) on which the stop-period-setting data (MP1, MP0) specifying a period of one or more display frames as e.g., the predetermined period are set overwritably.

According to the above arrangement, the scan-driving-stop period can be optimized according to the change in the period until the internal state transition owing to the interface mode change is stabilized, which depends on a display data interface speed and an internal action speed.

Stop-Period-Setting Data Supplied from Outside

In the display driver, the stop-period-setting data may be supplied e.g., from outside the display driver.

According to the above arrangement, it becomes easier to optimize the scan-driving-stop period according to control from the outside.

Interface Mode Arranged to be in Synchronization/Asynchronization with a Display Timing In the display driver, the interface modes include: e.g., a first interface mode (video mode) to input display data in synchronization with a display timing; and a second interface mode (command mode) to input display data in asynchronization with the display timing. In this case, the control circuit performs control for stopping the scan driving of the display panel during a predetermined period until the driving of the display panel by display data input in the second interface mode is enabled in case that display data input is switched from the first interface mode to the second interface mode.

According to the above arrangement, in case that the interface mode is switched from the first interface mode to the second interface mode, the scan driving of the display panel is stopped during the predetermined period. Therefore, even in the case of performing the process of storing display data input in the second interface mode in the frame buffer memory for display in synchronization with a display timing during the period, no disturbance of display is caused because a display state just before the switching is maintained. Further, it is unnecessary to perform the operation of previously accumulating, in the frame buffer, display data input in the first interface mode and in parallel with display thereof.

Frame Buffer Memory and Scale-Up Circuit

The display driver has e.g., a frame buffer memory (22) for storing display data input in the second interface mode, and a scale-up circuit (23) for scaling up image data so as to enlarge the number of display pixels according to image data stored in the frame buffer memory.

According to the above arrangement, even if the memory capacity of the frame buffer memory is insufficient and smaller than the data size of one-frame display data supplied in the first interface mode, and image data stored in the frame buffer memory needs to be scaled up, nothing interferes with the switching of the interface mode, and the disturbance of display can be prevented as described above.

MIPI

In the display driver, the interface circuit is e.g., MIPI circuit (20); the first interface mode is an action mode (video mode) compliant with MIPI video mode; and the second interface mode is an action mode (command mode) compliant with MIPI command mode. In MIPI video mode, display data are input as streams of pixel data in synchronization with a display timing. In MIPI command mode, display data to write into the frame buffer memory are input in asynchronization with the display timing. An instruction for the action of writing display data input in MIPI command mode into the frame buffer memory is given by an appropriate command.

LCD and OELD

In regard to the display driver, the above-described display panel is e.g., a liquid crystal display panel or an organic electroluminescence display panel. A display panel of this type is a representative example having a pixel structure arranged so that each time the pixels are selected by scan driving, their display signal information is overwritten; and it is ensured for such a display panel that even in case that its scan driving is stopped, the pixels continue holding information of signals driven based on immediately preceding display data thereof without losing such signal information.

LSI

The display driver is formed on a semiconductor substrate, for example. A display driver arranged like this is superior from the viewpoint of the downsizing, and also has a lower power consumption.

Stopping the Scan Driving of the Display Panel Following the Interface Mode Switching The display driver (1) according to the invention from another aspect has: an external interface circuit (2); a frame buffer memory (22); a control circuit (9); and drive circuits (27, 29). The external interface circuit has: a first interface mode (video mode) to input display data as streams of pixel data in synchronization with a display timing; and a second interface mode (command mode) to input display data for write on the frame buffer memory in asynchronization with the display timing. The drive circuit outputs signals (Scn_1 to Scn_m) for scanning pixels of a display panel in synchronization with the display timing, and pixel drive signals (Sig_1 to Sig_n) for display-driving the scanned pixels according to display data. The control circuit performs control for stopping the pixel scan on the display panel during a predetermined period until the output of the pixel drive signals is enabled based on display data input in the second interface mode in case that display data input is switched from the first interface mode to the second interface mode.

According to the above arrangement, with the scan driving of the display panel temporarily stopped, all of the pixels of the display panel can hold the information of signals driven based on the immediately preceding display data without losing it. Therefore, in the event of the switching of the interface mode in the middle of driving the display panel, the scan driving of the display panel is stopped during a predetermined period until the driving of the display panel by display data input in the second interface mode after switching is enabled, whereby the occurrence of display disturbance of display data in the additional second interface mode can be suppressed until the internal state transition owing to the change in the interface mode is stabilized. Further, in case that the interface mode is switched from the first interface mode to the second interface mode, the scan driving of the display panel is stopped during the predetermined period. Therefore, even in the case of performing the process of storing display data input in the second interface mode in the frame buffer memory in synchronization with a display timing during the period, no disturbance of display is caused because a display state just before the switching is maintained. Further, it is unnecessary to perform the operation of previously accumulating, in the frame buffer, display data input in the first interface mode and in parallel with display thereof.

Stop During Periods of one or more Display Frames

In the display driver, the predetermined period is e.g., periods of one or more display frames, of which the unit is a one-display frame period.

Taking into account that the display control and the write of display data into the frame buffer memory are performed in units of the display frame, the above arrangement significantly simplifies the control for temporarily stopping the scan driving of the display panel.

Register to Set Predetermined Periods on

In the display driver, the control circuit has a register (33) on which the stop-period-setting data (MP1, MP0) specifying a period of one or more display frames as e.g., the predetermined period are set overwritably.

According to the above arrangement, the scan-driving-stop period can be optimized according to the change in the period until the internal state transition owing to the interface mode change is stabilized, which depends on a display data interface speed and an internal action speed.

Stop-Period-Setting Data Supplied from Outside

In the display driver, the stop-period-setting data are supplied from outside the display driver, for example.

According to the above arrangement, it becomes easier to optimize the scan-driving-stop period according to control from the outside.

Scale-Up Circuit, which is Arranged on the Premise that no Data is Accumulated in FBM in Parallel with the Video Mode The display driver further includes a scale-up circuit (23) for scaling up image data so as to enlarge the number of display pixels according to image data stored in the frame buffer memory.

According to the above arrangement, even if the memory capacity of the frame buffer memory is insufficient and smaller than the data size of one-frame display data supplied in the first interface mode, and image data stored in the frame buffer memory need to be scaled up, nothing interferes with the switching of the interface mode and the disturbance of display can be prevented as described above.

The effect achieved by the representative embodiment of the embodiments disclosed herein will be briefly described below.

The disturbance of display owing to the switching of the input mode of display data can be substantially eliminated.

Turning now to FIG. 1, FIG. 1 shows, by example, the schematic structure of a liquid crystal display driver according to one embodiment of the invention. As an example of the display driver, a liquid crystal display driver (LCDDRV) 1 is described here. Although no special restriction is intended, the liquid crystal display driver 1 is formed on a semiconductor substrate such as a bulk of monocrystalline silicon by a known CMOS integrated circuit manufacturing technique and the like.

The liquid crystal display driver 1 receives a command and display data from a host device 3, and drives a liquid crystal display panel (PNL) 2 in synchronization with a display timing based thereon, thereby having a moving picture or a still image displayed.

Figure 2:
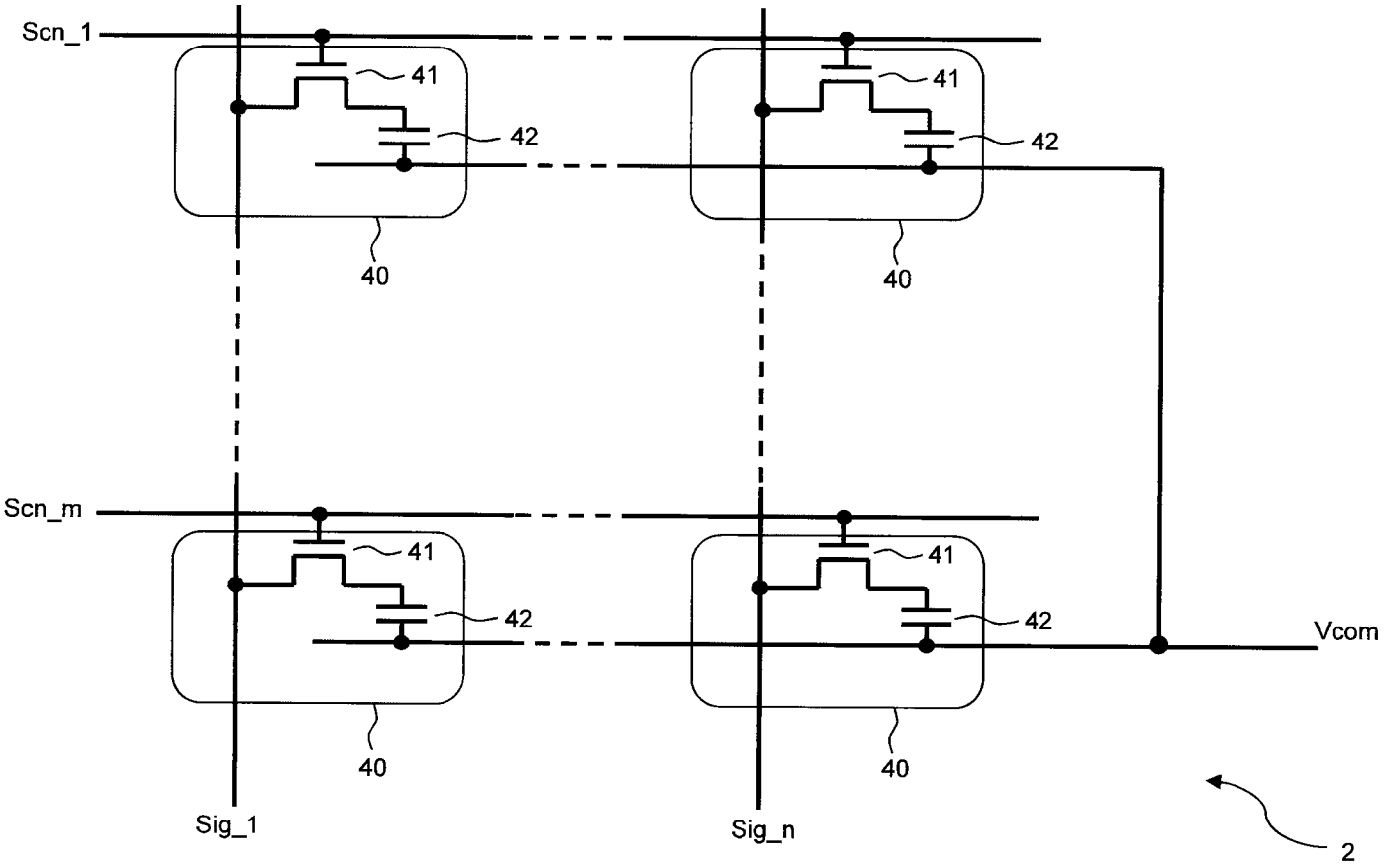
FIG. 2 is a circuit diagram showing, by example, the schematic structure of a liquid crystal display panel.

For instance, the liquid crystal display panel 2 has pixels 40 formed on a glass substrate and arranged like a matrix as shown in FIG. 2 by example; and each pixel 40 has a thin-film transistor 41 and a liquid crystal element 42 which are connected in series. A common potential Vcom is supplied to the liquid crystal elements 42 of the pixels. The select terminals of the thin-film transistors 41 are connected with scan electrodes Scn_1 to Scn_m corresponding to them in X direction, respectively; and the signal terminals of the thin-film transistors 41 are connected with signal electrodes Sig_1 to Sig_n corresponding to them in Y direction, respectively. The pixel lines of the respective scan electrodes Scn_1 to Scn_m are made display lines. The thin-film transistors 41 of the pixels 40 are turned ON in display lines, whereby the display lines are selected (scan of the display lines); and gradation voltages are applied to the liquid crystal elements 42 through the signal electrodes Sig_1 to Sig_n in each select period (horizontal display period) of the display lines. Turning OFF the thin-film transistors 41, the gradation voltages thus applied are held by capacitor components of the liquid crystal elements and serve to maintain the shutter condition of the liquid crystal element until the next time the pixels are selected.

The liquid crystal display driver 1 has: MIPI circuit 20 as an example of an external interface circuit having a plurality of input modes as the interface modes to input display data; and a system interface circuit 21. In this embodiment, the system interface circuit 21 is shown as a circuit operable to exchange commands and data with the host device bi-directionally. As a matter of course, the circuit configuration of the system interface circuit is compliant with MIPI, and it can be naturally arranged to be compliant with MDDI or bus interface specifications.

The MIPI circuit 20 has: a first interface mode to input display data in synchronization with a display timing, which is an action mode (also simply referred to as "video mode") compliant with MIPI video mode; and a second interface mode to input display data in asynchronization with the display timing, which is an action mode (also simply referred to as "command mode") compliant with MIPI command mode. The MIPI interface specifications of MIPI video mode, MIPI command mode and the like are described in MIPI Alliance Standard for Display Serial Interface V1.0 and others. According to the description thereof, the operations in MIPI command mode are a data write to the frame buffer memory and a data read therefrom, and a command write to a register and a command read therefrom. The operations in MIPI video mode are the action of inputting display data as streams of pixel data in synchronization with a display timing. In this embodiment, the video mode in MIPI circuit 20 is an action mode to input display data as streams of pixel data in synchronization with a display timing, and the command mode in MIPI circuit 20 is an action mode to input display data in asynchronization with a display timing because display data are written into a frame buffer memory according to an instruction of a command. In the command mode, the command input is performed on a register circuit 33 of a logic control part 30 from the system interface circuit 21. As described above, it is sufficient for the system interface circuit 21 compliant with MDDI to write a command and control data into the register circuit 33 of the logic control part 30 by the operation in MDDI command mode.

The logic control part 30 has a register circuit 33 into which the host device 3 writes control data, a command, etc. The logic control part decrypts the written command, refers to written control data, and produces various control signals for controlling the actions in the liquid crystal display driver. In the diagram, input-mode data DM of display data, and stop-period-setting data MP1, MP0 of two-bit scan, which are to be described later, are shown as control data set on the register circuit 33. Although no special restriction is intended, the video mode is specified when DM=1, whereas the command mode is specified when DM=0. The stop-period-setting data MP1, MP0 are to be described later in detail.

The display timing necessary for the liquid crystal display driver 1 to work is generated by the timing generation circuit 31. In case that display timing signals such as a horizontal synchronizing signal HSYNC and a vertical synchronizing signal VSYNC are supplied from the host device 3 together with display data as in input in the video mode, the timing generation circuit 31 produces, based on the horizontal synchronizing signal HSYNC and the vertical synchronizing signal VSYNC, a horizontal synchronizing signal HSYNC_int and a vertical synchronizing signal VSYNC_int for display control. On the other hand, in the case of inputting display data in asynchronization with a display timing as in input in the command mode, neither the horizontal synchronizing signal HSYNC nor the vertical synchronizing signal VSYNC is supplied from the outside, the timing generation circuit 31 produces a horizontal synchronizing signal HSYNC_int and a vertical synchronizing signal VSYNC_int for display control according to an instruction from the logic control part 30. In addition, the timing generation circuit 31 is arranged to be able to receive necessary operation clock signals and synchronizing clock signals from an oscillation circuit 28.

In response to the video mode being set on the register circuit 33, display data Ddat_vd input in a packet format according to the video mode are passed through a selector 24 and then, latched by a data latch circuit 25 in synchronization with a display timing sequentially. The display timing in this time is included in the packet format of the video mode, and created based on the horizontal synchronizing signal HSYNC and the vertical synchronizing signal VSYNC which are supplied to the timing generation circuit 3*l*. The data latch circuit 25 latches, in each horizontal display period defined by the horizontal synchronizing signal HSYNC, display data (display-line data) corresponding to display lines and provides the latched display data to a gradation voltage select circuit 26 of the subsequent stage. If the number of pixels of one display line is 1024, the data latch circuit 25 outputs data of 1024 pixels to the gradation voltage select circuit 26 in parallel. The gradation voltage select circuit 26 selects gradation voltages for driving the pixels according to display-line data thus transmitted, and provides the selected gradation voltages to a source drive circuit 27 in parallel. The source drive circuit 27 uses the supplied gradation voltages, namely supplies the gradation voltages to the corresponding signal electrodes Sig_1 to Sig_n to drive the signal electrodes. The action of driving the signal electrodes Sig_1 to Sig_n is repeated in every horizontal display period defined by the horizontal synchronizing signal HSYNC, during which a gate drive circuit 29 drives the scan electrodes Scn_1 to Scn_m to a select level, thereby switches the display lines to be selected sequentially. The time of switching between the display lines is set at intervals of the horizontal display period based on the horizontal synchronizing signal HSYNC_int, and the period for making a round of the select of the scan electrodes Scn_1 to Scn_m is a frame display period based on the vertical synchronizing signal VSYNC_int. The horizontal synchronizing signal HSYNC_int is defined by the horizontal synchronizing signal HSYNC included in the packet format of the video mode, whereas the vertical synchronizing signal VSYNC_int is defined by the vertical synchronizing signal VSYNC included in the packet format of the video mode.

In response to the command mode being set on the register circuit 33, display data Ddat_cm input in a packet format according to the command mode are written into the frame buffer memory 22 under the control of the logic control part 30. The control form of write into the frame buffer memory 22 is defined by e.g., a command and control data provided to the register circuit 33 through the system interface circuit 21 from the host device 3 in advance. For instance, the logic control part 30 is provided with vertical and horizontal pixel sizes of display data, input format of input display data according to the command mode, etc. in the form of control data, and it controls an address for write on the frame buffer memory 22 based on input synchronizing clocks of input data according to the command mode while counting the number of input words. The input of display data according to the command mode is asynchronous to the display timing and therefore, the write of display data to the frame buffer memory 22 is also asynchronous to the display timing. Although no special restriction is intended, it is presupposed here that display data input in the command mode are data which need the scale-up process, of which the number of pixels is small for the display frame in scale. Therefore, display data stored in the frame buffer memory 22 are subjected to a process such as interpolation in the scale-up circuit 23 and thus, scaled up. The display data thus scaled up are passed through the selector 24, and then, sequentially latched by the data latch circuit 25 in synchronization with a display timing. The timing generation circuit 31 creates the display timing at the time based on control data such as a dot clock frequency and the number of pixels of the display frame which are previously set on the logic control part 30. The display timing thus created is reflected on the horizontal synchronizing signal HSYNC_int and the vertical synchronizing signal VSYNC_int, and provided to the gate drive circuit 29. Further, the display timing is reflected on control signals to the data latch circuit 25, the gradation voltage select circuit 26, and the source drive circuit 27. The action frequency when accumulating display data in the frame buffer memory 22 according to the command mode is faster than the dot clock frequency in synchronization with the display timing and therefore, the data latch circuit 25 is capable of sequentially latching display data in units of display lines so as to be in time for the display timing. The data latch circuit 25 latches display data (display-line data) corresponding to display lines and provides the display data to the gradation voltage select circuit 26 of the subsequent stage in each required horizontal display period. The gradation voltage select circuit 26 selects gradation voltages for driving the pixels according to the display-line data transmitted thereto, and provides the selected gradation voltages to the source drive circuit 27 in parallel. The source drive circuit 27 uses the gradation voltages thus provided, namely supplies the gradation voltages to the corresponding signal electrodes Sig_1 to Sig_n to drive the signal electrodes. The action of driving the signal electrodes Sig_1 to Sig_n is repeated in every required horizontal display period, during which the gate drive circuit 29 drives the scan electrodes Scn_1 to Scn_m to a select level, thereby switches the display lines to be selected sequentially. The time of switching between the display lines is set at intervals of the horizontal display period based on the horizontal synchronizing signal HSYNC_int, and the period for making a round of the select of the scan electrodes Scn_1 to Scn_m is a frame display period based on the vertical synchronizing signal VSYNC_int.

The liquid crystal display driver 1 has a control circuit 9 which includes a scan-mask-signal generation circuit 32 in addition to the logic control part 30 and the timing generation circuit 31. While the display panel is driven for display drive, the scan-mask-signal generation circuit 32 outputs a scan-mask signal SCNMSK for stopping the scan driving on the liquid crystal display panel 2 for a predetermined period during which the driving of the display panel is enabled by display data input according to the command mode and supplies the scan-mask signal to the gate drive circuit 29 in case that the input mode of display data is switched from the video mode to the command mode in the MIPI circuit 20. As in FIG. 1, the scan-mask-signal generation circuit 32 is supplied with a mode signal ϕdm, a suspension-period signal ϕmp, and a vertical synchronizing signal VSYNC_int from the timing generation circuit 31. As the mode signal ϕdm, a logical value of mode data DM is supplied. The suspension-period signal ϕmp provides values of stop-period-setting data MP1, MP0 of two bits. The stop-period-setting data MP1, MP0 are control data which the host device 3 sets on the register circuit 33 programmably. For instance, stop-period-setting data MP1, MP0 take values as follows: (0, 0)=0; (0, 1)=1; (1, 0)=2; or (1, 1)=3. Depending on the values, the stop-period-setting data mean one to four fold the vertical display period (frame display period).

The scan-mask-signal generation circuit 32 produces a scan-mask signal SCNMSK=0 under the condition of ϕdm=1 (being in the video mode). The gate drive circuit 29 receiving the scan-mask signal SCNMSK performs the scan driving in each vertical display period defined by the vertical synchronizing signal VSYNC_int; and in the scan driving, the scan electrodes Scn_1 to Scn_m are sequentially selected in synchronization with the horizontal synchronizing signal HSYNC_int. On switching of from ϕdm=1 (video mode) to ϕdm=0 (command mode), the scan-mask-signal generation circuit 32 validates the value of the suspension-period signal ϕmp, and keeps the value of the scan-mask signal SCNMSK one(1) from the subsequent vertical display period to a vertical display period specified by the validated value. The gate drive circuit 29 stops selecting the scan electrodes Scn_1 to Scn_m during each vertical display period during which the scan-mask signal SCNMSK=1. An instruction by the host device 3 for switching the video mode to the command mode in display action is enabled by the logic control part 30 in a vertical line-return period, and is reflected on the subsequent display data input and display control. Therefore, it is not required to presuppose that the instruction by the host device 3 for switching the video mode to the command mode be executed in a vertical line-return period.

Figure 3:
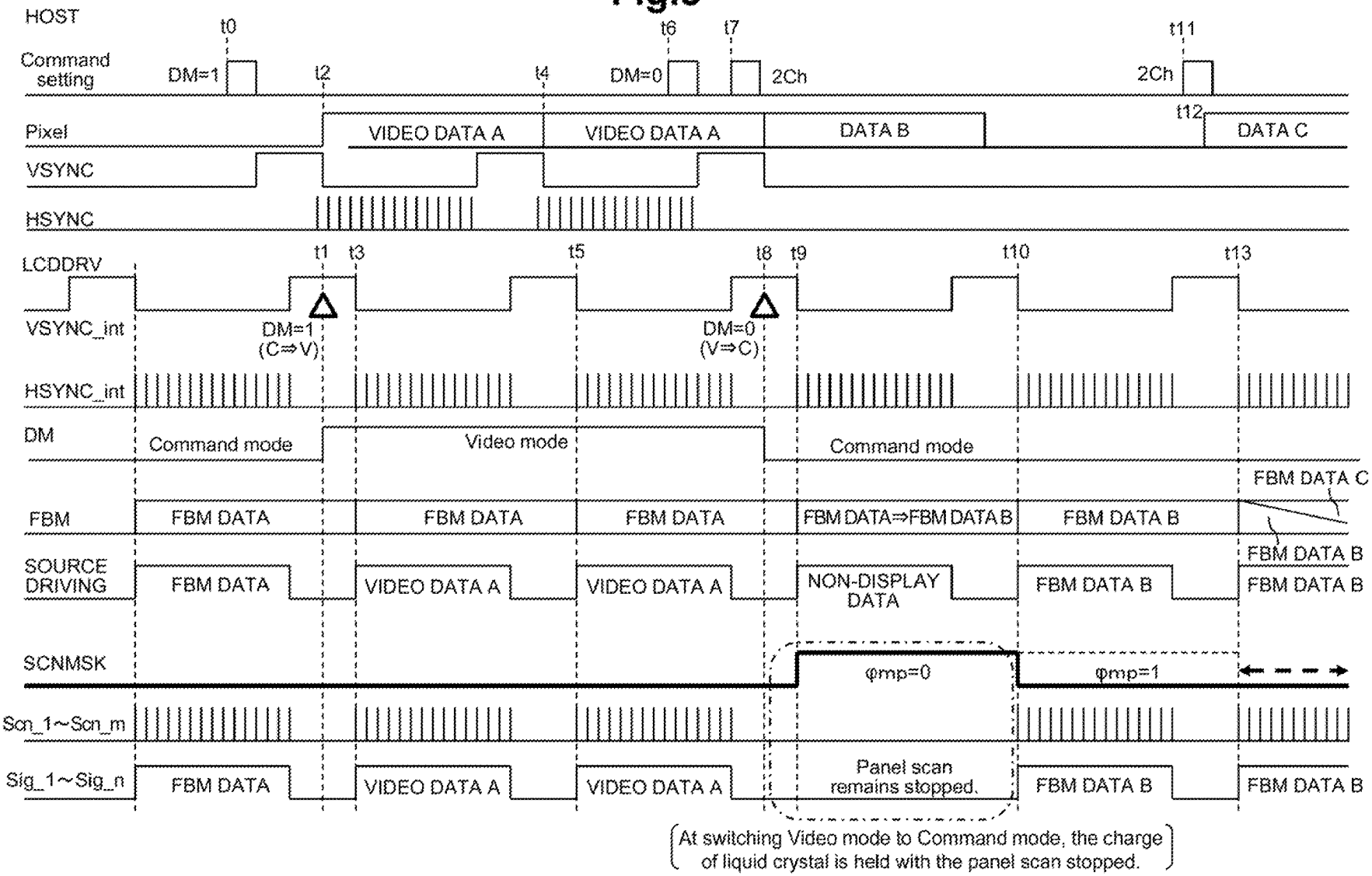
FIG. 3 is a timing chart showing, by example, the action timing when switching the interface mode of display data during display.

FIG. 3 shows, by example, the action timing when the video mode is switched to the command mode during display.

The host device 3 overwrites the value of input-mode data DM of the register circuit 33 into one(1)(t0), and display data (video data A) are supplied to the MIPI circuit 20 in synchronization with display synchronizing signals VSYNC, HSYNC (t2). The liquid crystal display driver 1 recognizes DM=1 in synchronization with display timing signals VSYNC_int, HSYNC_int in the vertical line-return period thereof (t1). The liquid crystal display driver 1 sends display data (video data A), which are input in synchronization with display synchronizing signals VSYNC, HSYNC in the video mode, to the source drive circuit 27 through the data latch circuit 25 (t3) and then, sequentially selects the display lines by use of the scan electrodes Scn_1 to Scn_m, and drives, by video data A, the signal electrodes Sig_1 to Sig_n while synchronizing with display timing signals VSYNC_int, HSYNC_int. Thereafter the host device 3 outputs display data of the subsequent display frame starting from t4 and then, the liquid crystal display driver 1 performs, with the subsequent display data (video data A), the scan driving of the liquid crystal display panel 2 and the signal electrode driving thereof while synchronizing with display timing signals VSYNC_int, HSYNC_int from t5 in the same way as described above. Incidentally, the scan-mask signal SCNMSK remains negated into a value of zero(0) because of DM=1.

Subsequently, the host device 3 overwrites the input-mode data DM of the register circuit 33 into the value of zero(0) to stop the supply of display data in the video mode (t6). Then, the liquid crystal display driver 1 recognizes DM=0 in a vertical line-return period of the display frame at the time of the stop, and turns the display data input mode to the command mode (t8), whereby the liquid crystal display driver is allowed to work for display in synchronization with display timing signals VSYNC_int, HSYNC_int. The host device 3 issues a command (2Ch) for writing display data into the frame buffer memory 22 (t7) and in parallel, starts supplying display data (data B) to write into the frame buffer memory 22 to the MIPI circuit 20. The liquid crystal display driver 1 starts the action of accumulating display data (data B) supplied in the command mode in the frame buffer memory 22 (t9). Since the frame buffer memory 22 is not used in the video mode, data (FBM data) remaining stored in the frame buffer memory 22 before that are overwritten by display data (FBM data B). It is presupposed here that it takes the time of a one-display frame period to finish the write. During the write action, the value of the scan-mask signal SCNMSK remains asserted into one(1). Only during the period, the scan driving on the scan electrodes Scn_1 to Scn_m is stopped (panel scan is stopped). Thus, the respective pixels of the liquid crystal display panel 2 are allowed to hold signal charges of the preceding display frame during the period. Therefore, even if during the period, the frame buffer memory 22 is overwritten, undesired data are put in the data latch circuit 25, or the source drive circuit 27 is supplied with an undesired gradation voltage, an immediately preceding image based on the preceding video mode can be displayed without stopping these circuit actions. On condition that display data (FBM data B) enough for display according to the command mode have been stored in the frame buffer memory 22 during a one-display frame period, the value of the scan-mask signal SCNMSK is negated into zero(0) (t10), thereby starting to display the display data (FBM data B) in synchronization with the display timing signals VSYNC_int, HSYNC_int. The display of display data (FBM data B) from the time t10 is continued from the display of display data (video data A) of a display frame from the time t9; and neither disturbance of display owing to an undesired image nor disturbance of display like dummy display in all white or black is interposed between the display from t9 and the display from t10. After that, the host device 3 issues a command (2Ch) to write display data for the subsequent display frame into the frame buffer memory 22 at the time t11 and concurrently, supplies display data (data C) to the liquid crystal display driver 1 at the time t12. In a display frame from the time t13, an already displayed data region is overwritten by the subsequent display data (FBM data C) in parallel with the display of display data (FBM data B) on the frame buffer memory 22.

Figure 4:
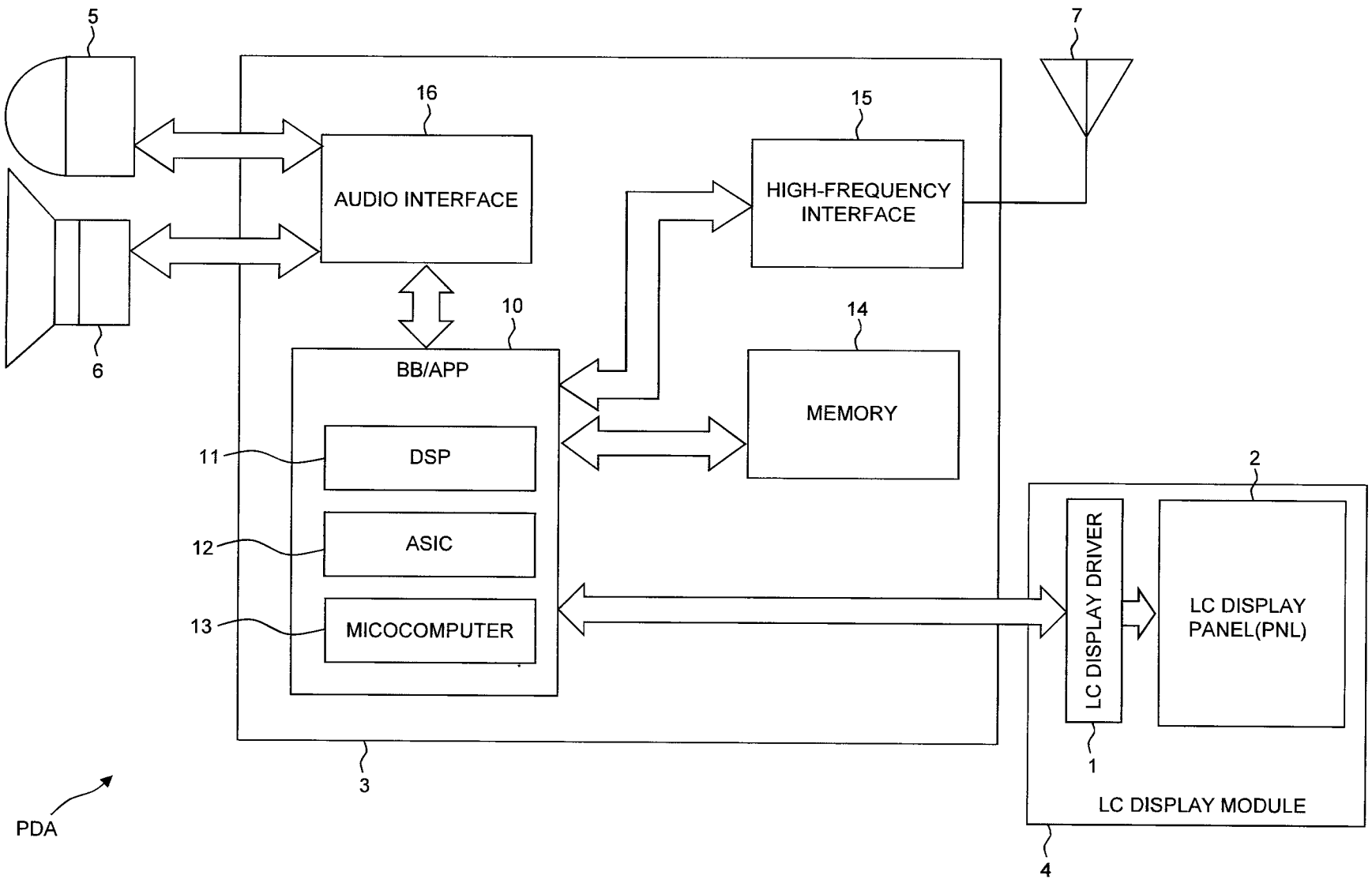
FIG. 4 is a block diagram showing an example of a portable communication terminal device to which the liquid crystal display driver of FIG. 1 is applied.

FIG. 4 shows an example of a portable communication terminal device to which the liquid crystal display driver 1 shown in FIG. 1 is applied. The personal digital assistance shown in the diagram is e.g., a portable telephone or smart phone, which is an embodiment of a data processing system.

The personal digital assistance PDA includes: a liquid crystal display module 4 as a display part; an antenna 7 for transmission and reception; a speaker 6 for audio output; a microphone 5 for audio input; and a host device 3. The liquid crystal display module 4 includes: a liquid crystal display panel 2 formed on a glass substrate; and a liquid crystal display driver 1 mounted on the glass substrate. Although no special restriction is intended, the host device 3 has: an audio interface 16 for performing signal input and output of the speaker 6 and the microphone 5; a high-frequency interface 15 for performing signal input and output to the antenna 7; a memory 14; and a base-band/application processor part (BB/APP) 10 for controlling a communication protocol process and other application processes. Although no special restriction is intended, BB/APP 10 has: DSP (Digital Signal Processor) 11 which performs signal processes in connection with audio signals and transmission and reception signals; ASIC (Application Specific Integrated Circuits) 12 which offers a custom function (user logic); and a microprocessor or microcomputer (hereinafter abbreviated as "MICON") 13 as a data processing unit which performs the control of the whole device including display control.

Although no special restriction is intended, the liquid crystal display panel 2 is a dot matrix panel of FHD (Full High Definition) which has a number of display pixels of e.g., 1920×1080 arranged like a matrix. In the case of a liquid crystal panel of color display type, one pixel is configured of three kinds of dots, namely red, blue and green ones. In the case of adopting a touch sensor panel as an input device, a touch sensor panel according to an electrostatic capacitance method or the like is arranged over a surface of the liquid crystal display panel 2, which is not shown particularly. In addition, a touch sensor panel controller operable to perform the drive control of the touch sensor panel and a sensing action, which is not shown, is arranged. The memory 14 is composed of e.g., a flash memory collectively erasable in units of a predetermined block, in which a control program to be executed by MICON 13 in communication control and display control, and control data used for communication control and display control are stored.

In the liquid crystal display panel 2, the scan electrodes and signal electrodes are arranged like a matrix; TFT (Thin Film Transistor) switches are formed at intersections thereof. Each TFT switch has a gate connected with the corresponding scan electrode, and a drain connected with the corresponding signal electrode. TFT switches are each connected with a liquid crystal pixel electrode of a liquid crystal capacitance forming a sub-pixel on the source side thereof; and electrodes of the liquid crystal capacitances on the opposite side make a common electrode. The signal electrodes are supplied with signal voltages output by the liquid crystal display driver 1 A scanning pulse from the liquid crystal display driver 1 is applied to the gate electrodes e.g., in the order of the array thereof, whereby the gate electrodes are driven.

A combination of the audio interface 16, BB/APP 10, and the memory 14 can be arranged as a SoC (System on Chip) semiconductor device of one chip. Further, the high-frequency interface 15 may be added to them to form a multi-chip or one-chip semiconductor device.

The effects and advantages achieved according to the above embodiments are as follows.

Switching the display data input from the video mode to the command mode, the display driver performs control for stopping the scan driving of the pixels on the scan electrodes Scn_1 to Scn_m of the liquid crystal display panel 2 during a predetermined period until the output of pixel drive signals to the signal electrodes Sig_1 to Sig_n is enabled based on display data input in the command mode. Therefore, in a period during which the scan driving of the liquid crystal display panel 2 is stopped temporarily, all the pixels of the liquid crystal display panel 2 can hold information of signals activated based on their immediately preceding display data without losing it. Hence, if the input mode of image information is switched with the liquid crystal display panel activated, the scan driving of the liquid crystal display panel 2 is kept stopped during a predetermined period in which the activation of the liquid crystal display panel 2 by display data input in the command mode after switching is enabled, whereby the occurrence of disturbance of display can be suppressed until the internal state transition owing to the change in image information input mode is stabilized. Even if the frame buffer memory 22 has a sufficient memory capacity, it is unnecessary to perform the operation of previously accumulating display data input in the video mode in the frame buffer memory 22 in parallel with display thereof. So, the power consumption attributed to access to the frame buffer memory can be reduced.

The scale-up circuit 23 is adopted in the above embodiment, which scales up image data so as to enlarge the number of the display pixels according to image data stored in the frame buffer memory 22. In this case, even if the memory capacity of the frame buffer memory 22 is insufficient and smaller than the data size of one-frame display data supplied in the video mode, and image data stored in the frame buffer memory 22 need to be scaled up, nothing interferes with the switching of the display data input mode and the disturbance of display can be prevented as described above.

To stop the scan driving for selecting the display lines for a predetermined period is all that is needed. It poses no problem to leave the circuit on the drive side of the signal electrodes working and therefore, the disturbance of display owing to the switching of the input mode of display data can be substantially eliminated.

The predetermined period during which the scan driving remains stopped is a period of at least one frame, of which the unit is e.g., a one-display frame period. Taking into account that the display control and the write of display data into the frame buffer memory 22 are performed for each display frame, the control arranged to temporarily stop the scan driving for the liquid crystal display panel 2 is remarkably simple.

The display driver has the register circuit 33 on which stop-period-setting data MP1, MP0 each specifying a period of one or more display frames as the predetermined period to keep the scan driving stopped are set overwritably. Taking into account that a period until the internal state transition owing to the change in display data input mode is stabilized changes depending on a display data interface speed and an internal action speed, the scan-driving-stop period can be optimized according to the change.

The stop-period-setting data can be supplied e.g., from outside the display driver and therefore, it becomes easier to optimize the scan-driving-stop period according to control from the outside.

While the invention made by the inventor has been concretely described above based on the embodiments, the invention is not limited to the embodiments. It is contemplated that various changes and modifications thereof may be made without departing from the subject matter thereof.

For instance, the interface modes to input display data are not limited to the video mode and the command mode compliant with MIPI. The interface modes of MDDI, RGB interface and the like may be included therein. In addition, the interface modes to input display data are not limited to the interface modes arranged to be in synchronization/asynchronization with a display timing as the video mode and the command mode are. For instance, in the case of MIPI, they may be interface modes different in the number of data lanes.

The period during which the scan driving remains stopped is not limited to a period of which the unit is the period of a display frame. Even in the event of the switching of the interface mode in the middle of a display frame period, the time of the end of the stop period thereof may be arranged to be coincident with an end of a display frame period (or a vertical line-return period).

The invention is not limited to the structure having the scale-up circuit. Also, in the case of the display driver having a frame buffer of a sufficient memory capacity, the action of accumulating display data in the frame buffer in parallel with display in the video mode can be omitted. It is obvious that the invention is applicable to such a structure that display data stored in the frame buffer memory are selectively passed through the scale-up circuit.

The display panel is not limited to a liquid crystal one. It may be another display panel, such as an organic electroluminescence display panel. In short, the display panel may be any one as long as it has a display form in which the preceding display drive signal information can be held by the pixels at the stop of the scan driving.

The display driver is not limited to one formed on a semiconductor substrate independently. The display driver may be mounted in a semiconductor substrate together with another circuit, e.g., a touch panel controller, a microcomputer or the like, or it may be installed on a single module substrate.

What is claimed is:

1. A display driver, comprising:

interface circuitry having interface modes comprising a first interface mode and a second interface mode different from the first interface mode, the interface circuitry is configured to input first display data in the first interface mode and second display data in the second interface mode, wherein the display driver is configured to drive a display panel based on the first display data inputted and the second display data; and control circuitry configured to, based on a command signal received from a device external to the display driver and while the first display data is input in the first interface mode and driven on the display panel, stop scan-drive of the display panel during a period until driving of the display panel in the second interface mode is enabled, wherein the period occurs between driving the display panel based on the first display data and driving the display panel based on the second display data.

2. The display driver according to claim 1, wherein the period is a period of one or more display frames.

3. The display driver according to claim 1, wherein the period is based on stop-period-setting data stored within a register.

4. The display driver according to claim 3, wherein the stop-period-setting data are received from outside the display driver.

5. The display driver according to claim 1, wherein the interface circuitry is further configured to:

input the first display data in synchronization with a display timing in the first interface mode; and input the second display data in asynchronization with the display timing in the second interface mode.

6. The display driver according to claim 1, further comprising:

a frame buffer memory configured to store the second display data inputted in the second interface mode; and scale-up circuitry configured to scale up image data to enlarge a number of display pixels.

7. The display driver according to claim 1, wherein the display panel is one of a liquid crystal display panel and an organic electroluminescence display panel.

8. The display driver according to claim 1, further comprising:

a frame buffer memory;

wherein the first display data is inputted as streams of pixel data in synchronization with a display timing in the first interface mode, and the second display data is inputted for write on the frame buffer memory in asynchronization with the display timing in the second interface mode;

wherein the display driver is further configured to:

output signals for scanning pixels of the display panel in synchronization with the display timing; and output pixel drive signals for display-driving the scanned pixels according to the first display data, and wherein stopping scan-drive of the display panel comprises stopping pixel scan on the display panel during the period.

9. A display system comprising:

a display panel; and a display driver configured to drive the display panel and comprising:

interface circuitry having interface modes comprising a first interface mode and a second interface mode different from the first interface mode, the interface circuitry is configured to input first display data in the first interface mode and second display data in the second interface mode;

driver circuitry configured to drive the display panel based on the first display data and the second display data; and control circuitry configured to, based on a command signal received from a device external to the display driver and while the first display data is input in the first interface mode and driven on the display panel, stop scan-drive of the display panel during a period until driving of the display panel in the second interface mode is enabled, wherein the period occurs between driving the display panel based on the first display data and driving the display panel based on the second display data.

10. The display system according to claim 9, wherein the period is specified by stop-period-setting data stored in a register.

11. The display system according to claim 9, wherein the interface circuitry is further configured to:

input the first display data in synchronization with a display timing in the first interface mode; and input the second display data in asynchronization with the display timing in the second interface mode.

12. The display system according to claim 9, further comprising:

a frame buffer memory configured to store the second display data inputted in the second interface mode; and scale-up circuitry configured to scale up image data to enlarge a number of display pixels.

13. The display system according to claim 9, wherein the first interface mode is a video mode and the second interface mode is a command mode.

14. A method of driving a display panel, the method comprising:

driving, with a display driver, the display panel with first display data inputted in a first interface mode of interface modes of interface circuitry and second display data inputted in a second interface mode of the interface modes, wherein the second interface mode differs from the first interface mode; and stopping, with control circuitry and based on a command signal received from a device external to the display driver and while the first display data is input in the first interface mode and driven on the display panel, scan driving of the display panel during a period until driving of the display panel in the second interface mode is enabled, wherein the period occurs between driving the display panel based on the first display data and driving the display panel based on the second display data.

15. The method according to claim 14, wherein the period is specified by stop-period-setting data stored within a register.

16. The method according to claim 15, further comprising setting the register with stop-period-setting data specifying the period as including one or more display frames.

17. The method according to claim 15 further comprising:

inputting the first display data in in synchronization with a display timing; and inputting the second display data in asynchronization with the display timing.

18. The display driver of claim 1, wherein an image based on the first interface mode is displayed by the display panel during the period.

19. The display driver of claim 1, wherein the command signal indicates a switch from the first interface mode to the second interface mode.

20. The display driver of claim 19, wherein a register value is changed from a first value indicating the first interface mode to a second value indicating the second interface mode based on the command signal.

* * * * *